US007884786B2

(12) United States Patent
Kim et al.

(10) Patent No.: US 7,884,786 B2
(45) Date of Patent: Feb. 8, 2011

(54) ORGANIC LIGHT EMITTING DISPLAY HAVING DEMULTIPLEXERS AND PARASITIC CAPACITANCES

(75) Inventors: Yang Wan Kim, Seocho-gu (KR); Choon Yul Oh, Gunpo (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 840 days.

(21) Appl. No.: 11/251,615

(22) Filed: Oct. 13, 2005

(65) Prior Publication Data

US 2006/0139255 A1 Jun. 29, 2006

(30) Foreign Application Priority Data

Oct. 13, 2004 (KR) ..... 10-2004-0081812

(51) Int. Cl.
*G09G 3/32* (2006.01)

(52) U.S. Cl. ..... 345/83

(58) Field of Classification Search ..... 345/204, 345/82–100, 690, 76
See application file for complete search history.

(56) References Cited

U.S. PATENT DOCUMENTS 7,091,936 B1 * 8/2006 Yamada ..... 345/76
7,245,278 B2 * 7/2007 Hu et al. ..... 345/82
7,714,815 B2 * 5/2010 Kim et al. ..... 345/82
2001/0050665 A1 12/2001 Yeo et al.
2002/0011976 A1 * 1/2002 Hashimoto ..... 345/76
2003/0107537 A1 * 6/2003 Ochi et al. ..... 345/83
2003/0179164 A1 * 9/2003 Shin et al. ..... 345/76
2004/0017341 A1 1/2004 Maki
2004/0080478 A1 * 4/2004 Akimoto ..... 345/87
2004/0207583 A1 * 10/2004 Koo et al. ..... 345/82

FOREIGN PATENT DOCUMENTS

KR 10-2004-0066289 7/2004

* cited by examiner

*Primary Examiner*—Amr Awad
*Assistant Examiner*—Liliana Cerullo
(74) *Attorney, Agent, or Firm*—Christie, Parker & Hale, LLP

(57) ABSTRACT

An organic light emitting display that reduces the number of output lines from a data driver, attains image stability, and adjusts white balance. A plurality of demultiplexers at the primary output lines of the data driver simultaneously supply the data signals from each primary output line to a plurality of secondary output lines allowing a reduced number of primary output lines. A plurality of parasitic capacitors are formed where data lines are coupled with the pixels and are charged to a voltage corresponding to the data signal that is simultaneously provided to the pixels allowing an image of uniform brightness to be displayed. The scan period and the data period are not overlapping allowing a stable image. Capacitance values of data capacitors are set taking into consideration the light emitting efficiency of organic light emitting diodes, allowing an image of adjusted white balance.

12 Claims, 8 Drawing Sheets

ORGANIC LIGHT EMITTING DISPLAY HAVING DEMULTIPLEXERS AND PARASITIC CAPACITANCES

CROSS-REFERENCE TO RELATED APPLICATION

This application claims priority to and the benefit of Korean Patent Application No. 2004-0081812, filed on Oct. 13, 2004, in the Korean Intellectual Property Office, the entire content of which is incorporated herein by reference.

BACKGROUND

1. Field of the Invention

The present invention relates to an organic light emitting display, and more particularly to an organic light emitting display capable of reducing the number of output lines of a data driver and capable of adjusting white balance.

2. Discussion of Related Art

Recently, various flat panel displays have been developed, which present desirable substitutes for a Cathode Ray Tube (CRT) display that is relatively heavy and bulky. Flat panel displays include Liquid Crystal Displays (LCDs), Field Emission Displays (FEDs), Plasma Display Panels (PDPs), Organic Light Emitting Displays, and the like.

Among flat panel display devices, the organic light emitting display creates an image using an organic light emitting diode that is an emissive element that generates light by the recombination of electrons and holes. Such an organic light emitting display has advantages of high response speed and low power consumption. Typically, light emitting displays supply an electric current corresponding to a data signal to the organic light emitting diode using a thin film transistor formed in every pixel. The current causes the organic light emitting diode to emit light.

FIG. 1 is shows a conventional organic light emitting display. Referring to FIG. 1, the conventional organic light emitting display includes a pixel portion 30, a scan driver 10, a data driver 20, and a timing controller 50. The pixel portion 30 includes a plurality of pixels 40 formed at a crossing area of scan lines S1 to Sn and data lines D1 to Dm. The scan driver 10 drives the scan lines S1 to Sn and light emission control lines E1 to En. The data driver 20 drives the data lines D1 to Dm. The timing controller 50 controls the scan driver 10 and the data driver 20.

The scan driver 10 generates a scan signal in response to a scan drive control signal SCS from the timing controller 50, and sequentially provides the generated scan signal to the scan lines S1 to Sn. The scan driver 10 also generates a light emission control signal in response to the scan drive control signal SCS from the timing controller 50, and sequentially provides the generated light emission control signal to the light emission control lines E1 to En.

The data driver 20 receives the data drive control signal DCS from the timing controller 50. Upon receiving the data drive control signal DCS, the data driver 20 generates data signals, and provides the generated data signals to the data lines D1 to Dm. The data driver 20 provides the generated data signals to all of the data lines D1 to Dm once every one horizontal period.

The timing controller 50 generates a data drive control signal DCS and the scan drive control signal SCS according to externally supplied synchronous signals. The data drive control signal DCS generated by the timing controller 50 is provided to the data driver 20, and the scan drive control signal SCS is provided to the scan driver 10. Furthermore, the timing controller 50 provides externally supplied data Data to the data driver 20.

The pixel portion 30 receives power a first power supply VDD and a second power supply VSS that are outside the pixel portion 30, and provides them to respective pixels 40. Upon receiving power from the first power supply VDD and the second power supply VSS, the pixels 40 produce a current of controlled magnitude corresponding to the data signal flowing from the first power supply VDD to the second power supply VSS through a light emitting element, thus generating light corresponding to the data signal. Furthermore, light emitting periods of the pixels 40 are controlled by the light emission control signal.

In the conventional organic light emitting display, each of the pixels 40 is positioned at a crossing of the scan lines S1 to Sn and the data lines D1 to Dm. The data driver 20 includes m output lines for supplying a data signal to m data lines D1 to Dm. That is, in the conventional organic light emitting display, the data driver 20 includes the same number of output lines as the data lines D1 to Dm. Accordingly, at least one data driving circuit is required in the data driver 20 that has m output lines. As resolution and size of the pixel portion 30 are increased, the data driver 20 needs more output lines, thereby increasing manufacturing cost.

SUMMARY OF THE INVENTION

Accordingly, the present invention provides an organic light emitting display that reduces the number of output lines from a data driver and adjusts white balance.

An embodiment of the present invention provides an organic light emitting display including: a scan driver for supplying a scan signal to a plurality of scan lines, a data driver for supplying a data signal to a plurality of output lines, a plurality of demultiplexers installed at the output lines for supplying the data signals to the output lines, and a pixel portion coupled with the scan lines, the data lines, and a pixel power line, and including a red pixel with a red organic light emitting diode, a green pixel with a green organic light emitting diode, and a blue pixel with a blue organic light emitting diode. A plurality of first parasitic capacitors are formed at primary data lines coupled with the red pixels for charging a voltage corresponding to the data signal. A plurality of second parasitic capacitors are formed at secondary data lines coupled with the green pixels for charging a voltage corresponding to the data signal. A plurality of third parasitic capacitors formed at third data lines coupled with the blue pixel for charging a voltage corresponding to the data signal. Further, the first, second, and third parasitic capacitors have different capacitance values.

In one embodiment, the capacitance of the second parasitic capacitor is set to be greater than that of the first parasitic capacitor and to be smaller than that of the third parasitic capacitor. In another embodiment, the organic light emitting display includes a power line for providing power from a first power supply to the pixel power line. The first power supply is located outside the pixel portion. In yet another embodiment, a first overlapping area, a second overlapping area, and a third overlapping area are set differently from each other. The first overlapping area is an overlapping area between the first power line and a data line coupled with the red pixel, the second overlapping area is an overlapping area between the first power line and a data line coupled with the green pixel, and the third overlapping area is an overlapping area between the first power line and a data line coupled with the blue pixel.

In one embodiment, the first overlapping area is set to be smaller than the second overlapping area but greater than the third overlapping area.

DETAILED DESCRIPTION

Figure 1:
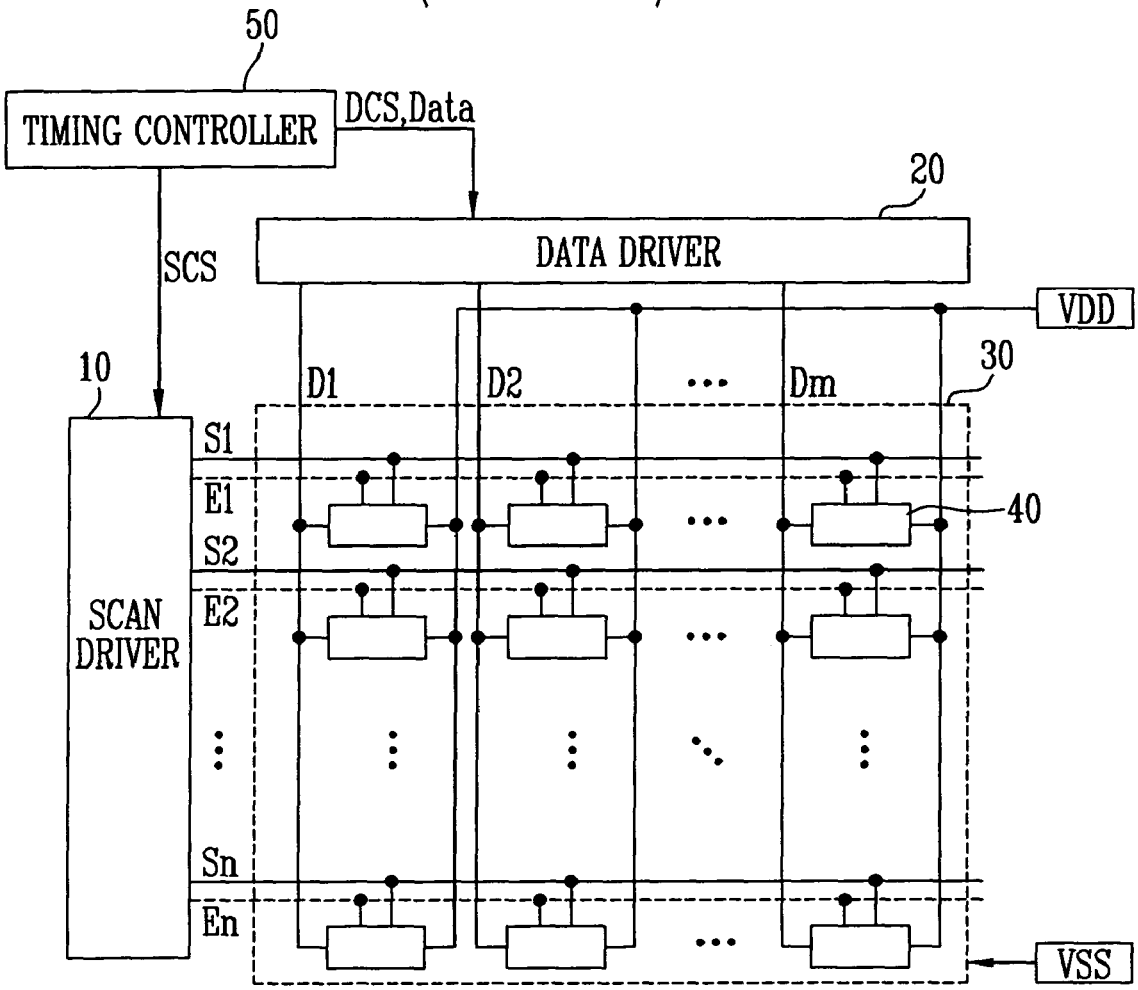
FIG. 1 (PRIOR ART)
FIG. 1 shows a conventional organic light emitting display.
Figure 2:
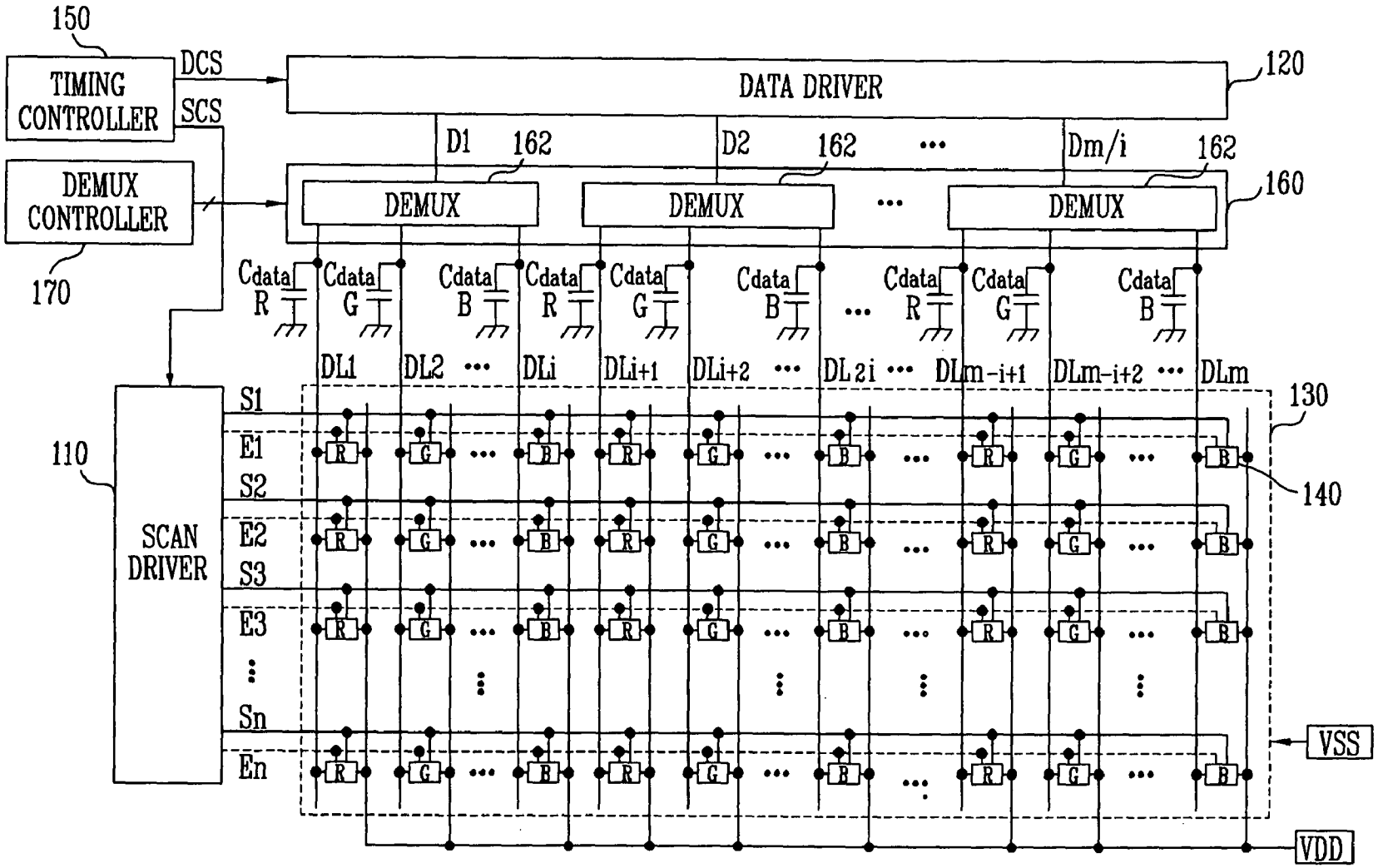
FIG. 2 shows an organic light emitting display according to an embodiment of the present invention.

FIG. 2 shows an organic light emitting display according to an embodiment of the present invention. The organic light emitting display according to an embodiment of the present invention includes a scan driver 110, a data driver 120, a pixel portion 130, a timing controller 150, a demultiplexer block 160, a demultiplexer controller 170, and data capacitors Cdata.

The pixel portion 130 includes a plurality of pixels 140 positioned at areas partitioned by scan lines S1 to Sn, and secondary data lines DL1 to DLm. Each of the pixels 140 generates light corresponding to a data signal supplied from a corresponding secondary data line DL. Each pixel 140 is divided into a red pixel R generating red light, a green pixel R generating green light, and a blue pixel B generating blue light.

The scan driver 110 generates a scan signal SS in response to scan control signals SCS supplied from the timing controller 150, and sequentially supplies the generated scan signal SS to the scan lines S1 to Sn. The scan driver 110 supplies the scan signal SS only during a part of the one horizontal period 1H (FIG. 4).

Figure 4:
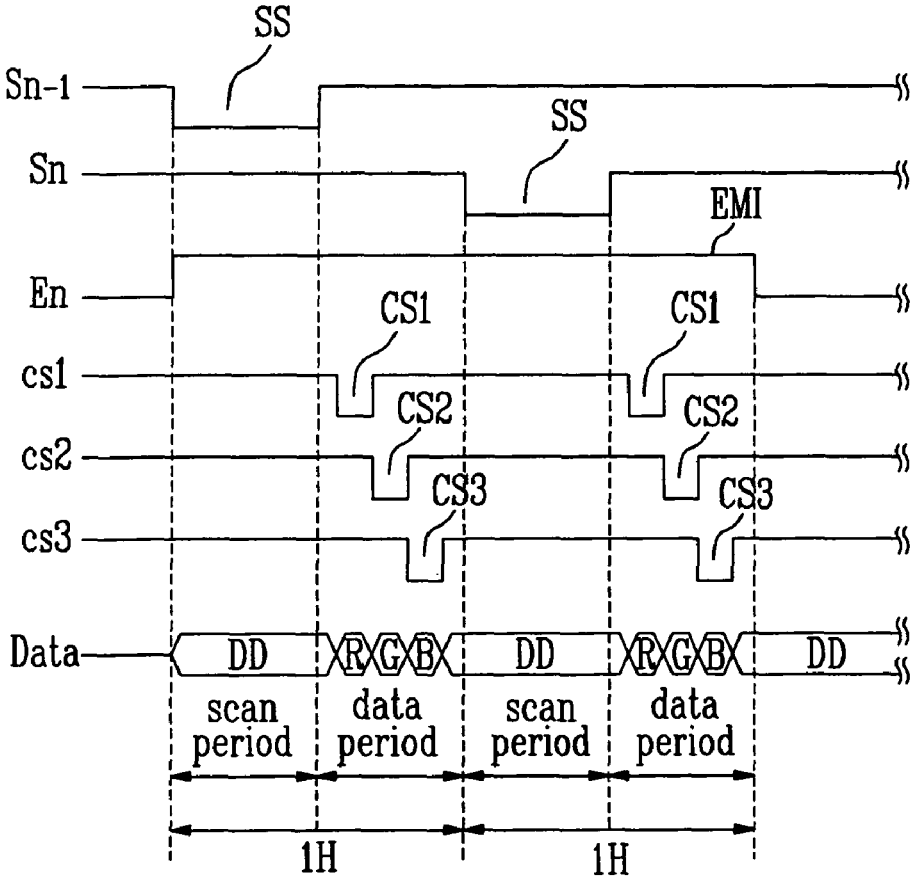
FIG. 4 is a wave form chart of signals that are supplied to a scan line, a data line, and a demultiplexer.

FIG. 4 is a waveform chart of signals that are supplied to various elements of the organic light emitting display shown in FIG. 2. Waveforms and time divisions shown in FIG. 4 are relevant to the other drawings and are interwoven with the descriptions of each drawing.

In one embodiment, the one horizontal period 1H is divided into a scan period (first period) and a data period (second period). The scan driver 110 supplies the scan signal SS during the scan period of the one horizontal period 1H, but does not supply the scan signal SS during the data period of the one horizontal period 1H. On the other hand, the scan driver 110 generates a light emission control signal EMI responsive to the scan drive control signals SCS, and sequentially provides the light emission control signal EMI to light emission control lines E1 to En.

The data driver 120 generates data signals responsive to data drive control signals DCS supplied from the timing controller 150, and provides the generated data signals to primary data lines D1 to Dm/i. The data driver 120 sequentially provides i data signals (FIG. 4) to the primary data lines D1 to Dm/i installed at output lines of the data driver 120, where i is a natural number greater than 2.

The data driver 120 sequentially provides i data signals R, G, B to be supplied to a pixel during the data period of one horizontal period 1H (FIG. 4). As explained above, the data period and the scan period of one horizontal period 1H are distinct. Therefore, because data signals R, G, B are supplied to a pixel only during the data period, supply time of the data signals R, G, B to the real pixel does not overlap with supply time of the scan signal SS. Furthermore, the data driver 120 supplies dummy data DD regardless of brightness during the scan period of one horizontal period 1H. Because the dummy data DD do not contribute to the brightness, the dummy data DD may be omitted.

The timing controller 150 generates data drive control signals DCS and scan drive control signals SCS according to externally supplied synchronous signals. The data drive control signals DCS and the scan drive control signals SCS generated by the timing controller 150 are provided to the data driver 120 and the scan driver 110, respectively.

The demultiplexer block 160 includes m/i demultiplexers 162. In other words, the demultiplexer block 160 includes one demultiplexer 162 corresponding to each one of the primary data lines D1 to Dm/i, and coupled with the corresponding data line D. Moreover, each of demultiplexers 162 is coupled with i of the secondary data lines DL. The demultipixer 162 having the structure mentioned above, provides i data signals supplied to the one primary data line D during a data period to the second i data lines DL.

In this embodiment a data signal supplied to one of the primary data lines D is provided to i of the secondary data lines DL using the demultiplexer 162. When the data signal supplied to one of the primary data line D, is provided to i of the secondary data lines DL, the number of output lines required in the data driver 120 is reduced. For example, if "i" is 3, the number of output lines required in the data driver 120 is reduced to ⅓ of the number of conventional output lines. Accordingly, the number of data integrated circuits required in the data driver 120 is also reduced and manufacturing cost is reduced.

The demultiplexer controller 170 provides i control signals to each one of the demultiplexers 162 over the one horizontal period (1H), so that i data signals supplied to each one of the primary data lines D can be divided and provided to i of the secondary data lines DL. The i control signals supplied from the demultiplexer controller 170 are sequentially supplied during the data period in order to not overlap one another (FIG. 4). Although the demultiplexer controller 170 is shown outside of the timing controller 150 in FIG. 2, the demultiplexer controller 170 may be provided inside the timing controller 150 in different embodiments of the present invention.

Data capacitors Cdata are installed on every secondary data line DL. Each data capacitor Cdata temporarily stores the data signal supplied to the secondary data line DL, and provides the stored data signal to the pixel 140. The data capacitors Cdata may be parasitic capacitors equivalently formed at the secondary data lines DL. If the parasitic capacitors Cdata equivalently formed at the secondary data lines DL have capacitance values greater than capacitance of a storage capacitor C (FIG. 5) included in each pixel 140, then the parasitic capacitors Cdata may stably store the data signal.

Figure 3:
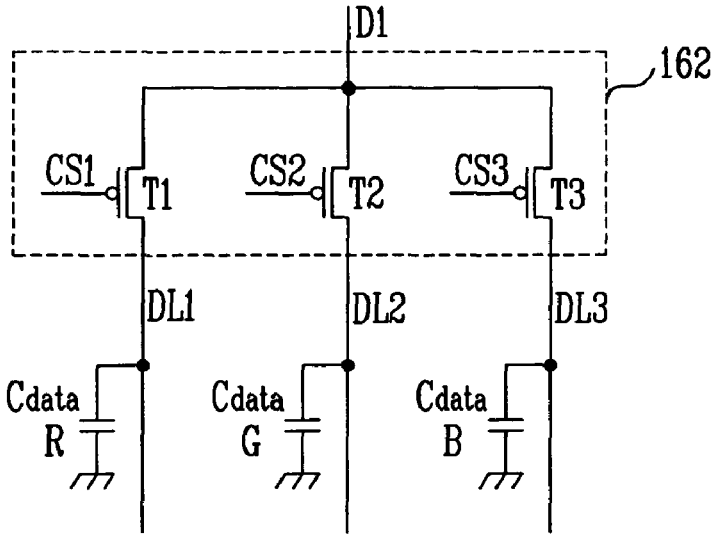
FIG. 3 is a detailed circuit diagram of an exemplary embodiment of a demultiplexer shown in FIG. 2.

FIG. 3 is a circuit diagram of the demultiplexer 162 shown in FIG. 2. In the exemplary embodiments shown and described, it is assumed that "i" is 3 and the demultiplexer 162 is coupled with the primary data line D1.

The demultiplexers 162 each include a first switch T1, a second switch T2, and a third switch T3. The first, second, and third switches T1, T2, T3 may be transistors.

The first switch T1 is installed between a first primary data line D1 and a first secondary data line DL1. When a first control signal CS1 from the demultiplexer controller 170 is supplied to the first switch T1, the first switch T1 is turned on and provides the data signal supplied to the first primary data line D1 to the first secondary data line DL1. The data signal supplied to the first secondary data line DL1 is temporarily stored in a first data capacitor CdataR.

The second switch T2 is installed between the first primary data line D1 and a second secondary data line DL2. When a second control signal CS2 from the demultiplexer controller 170 is supplied to the second switch T2, the second switch T2 is turned on and provides the data signal supplied to the first primary data line D1 to the second secondary data line DL2. The data signal supplied to the second secondary data line DL2 is temporarily stored in a second data capacitor CdataG.

The third switch T3 is installed between the first primary data line D1 and a third secondary data line DL3. When a third control signal CS3 from the demultiplexer controller 170 is supplied to the third switch T3, the third switch T3 is turned on and provides the data signal supplied to the first primary data line D1 to the third secondary data line DL3. The data signal supplied to the third secondary data line DL3 is temporarily stored in a third data capacitor CdataB.

Figure 5:
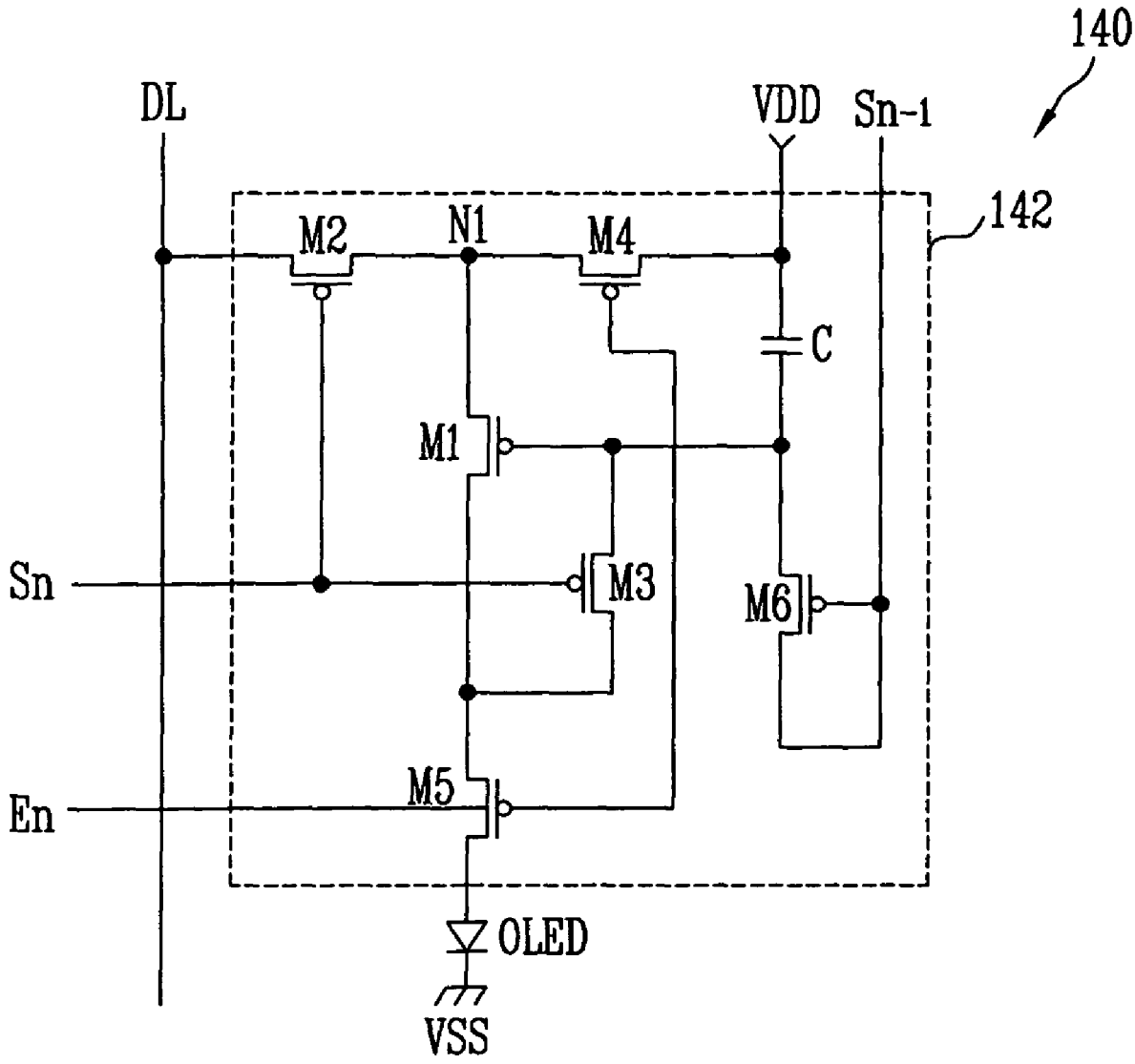
FIG. 5 is a circuit diagram of an exemplary embodiment of a pixel shown in FIG. 2.

FIG. 5 is an exemplary circuit diagram for the pixel 140 shown in FIG. 2. The pixel 140 may have alternative circuits in various embodiments of the present invention. Operation of the demultiplexer 162 is described in view of the circuit of the pixel 140.

Pixels 140 according to a first embodiment of the present invention each include a pixel circuit 142 coupled with a light emitting element OLED, one of the secondary data lines DL, one of the scan lines Sn, and one of the light emission control lines En.

Anode electrode of the light emitting element OLED is coupled with the pixel circuit 142, and its cathode electrode is coupled with the second power supply VSS. The second power supply VSS has a voltage lower than that of the first power supply VDD. For example, the voltage of the second power supply VSS may be at ground voltage. The light emitting elements OLED generate a red light, a green light, or a blue light corresponding to a current supplied from the pixel circuit 142. To emit light under the influence of an electrical current, the light emitting element OLED is formed from organic materials having fluorescent and/or phosphorescent materials. The light emitting element OLED may be an organic light emitting diode.

The pixel circuit 142 includes the storage capacitor C, a first transistor M1, a second transistor M2, a third transistor M3, a fourth transistor M4, a fifth transistor M5, and a sixth transistor M6. The storage capacitor C and the sixth transistor M6 are coupled between the first power supply VDD and the $n-1^{th}$ scan line Sn−1. The fifth transistor M5 is coupled between the light emitting element OLED and is controlled by the light emission control line En. The first transistor M1 is coupled between the fifth transistor M5 and a first node N1. The third transistor M3 is coupled between a gate terminal and a drain terminal of the first transistor M1. Although the first to sixth transistors M1 to M6 are shown as p-type MOSFETs, the present invention is not limited to PMOS transistors. In one alternative, the first to sixth transistors M1 to M6 may be n-type MOSFETs which would be driven with waveform of inverted polarity compared to the waveforms shown in FIG. 4 for PMOS transistors.

A source terminal of the first transistor M1 is coupled with the first node N1, and the drain terminal of the first transistor M1 is coupled to a source terminal of the fifth transistor M5. Moreover, the gate terminal of the first transistor M1 is coupled with the storage capacitor C. The first transistor M1 provides a current corresponding to a voltage charged in the storage capacitor C to the light emitting element OLED.

A drain terminal of the third transistor M3 is coupled with the gate terminal of the first transistor M1, and a source terminal of the third transistor M3 is coupled to the drain terminal of the first transistor M1. Further, a gate terminal of the third transistor M3 is coupled with the $n^{th}$ scan line Sn. When the scan signal SS is supplied to the $n^{th}$ scan line Sn, the third transistor M3 is turned on, thereby causing the first transistor M1 to be diode-coupled. That is, when the third transistor M3 is turned on, the first transistor M1 is diode-coupled.

A source terminal of the second transistor M2 is coupled with the data line DL, and a drain terminal of the second transistor M2 is coupled with the first node N1. Moreover, a gate terminal of the second transistor M2 is coupled with the $n^{th}$ scan line Sn. When the scan signal SS is provided to the $n^{th}$ scan line Sn, the second transistor M2 is turned on, thereby providing the data signal from the data line DL to the first node N1.

A drain terminal of the fourth transistor M4 is coupled with the first node N1, its source terminal is coupled with the first power supply VDD, and its gate terminal is coupled with the light emission control line En. When a light emission control signal EMI is not supplied, in other words when this signal is low, the fourth transistor M4 is turned on to electrically couple the first node N1 to the first power supply VDD.

A source terminal of the fifth transistor M5 is coupled with the drain terminal of the first transistor M1, and a drain terminal of the fifth transistor M5 is coupled to the light emitting element OLED. In addition, a gate terminal of the fifth transistor M5 is coupled with the light emission control line En. When the light emission control signal EMI is not being provided, in other words the signal is low, the fifth transistor M5 is turned on, thus providing a current from the first transistor M1 to the light emitting element OLED.

A source terminal of the sixth transistor M6 is coupled with the storage capacitor C, a drain terminal and a gate terminal thereof are coupled with the $(n-1)^{th}$ scan line Sn−1. When the scan signal SS is supplied to the $n-1^{th}$ scan line Sn−1, the sixth transistor M6 is turned on, thereby initializing the storage capacitor C and the gate of the first transistor M1.

In the exemplary embodiment shown in FIG. 5, all the transistors are depicted as PMOS that turns on in response to a low signal. Some of the signal waveforms shown in FIG. 4 have a high base and turn low during the application of the signal. Examples of these type are the scan signals and the control signals applied to the scan lines Sn, Sn−1 and the first, second, and third control lines cs1, cs2, cs3. On the other hand, the emission control signal EMI applied to the emission control lines En, is normally low and goes high during the application of the emission control signal EMI. As a result, while the emission control signal EMI is being applied, the PMOS transistor receiving this signal turns off while when the other signals are being applied their corresponding PMOS transistors turn on.

Figure 6:
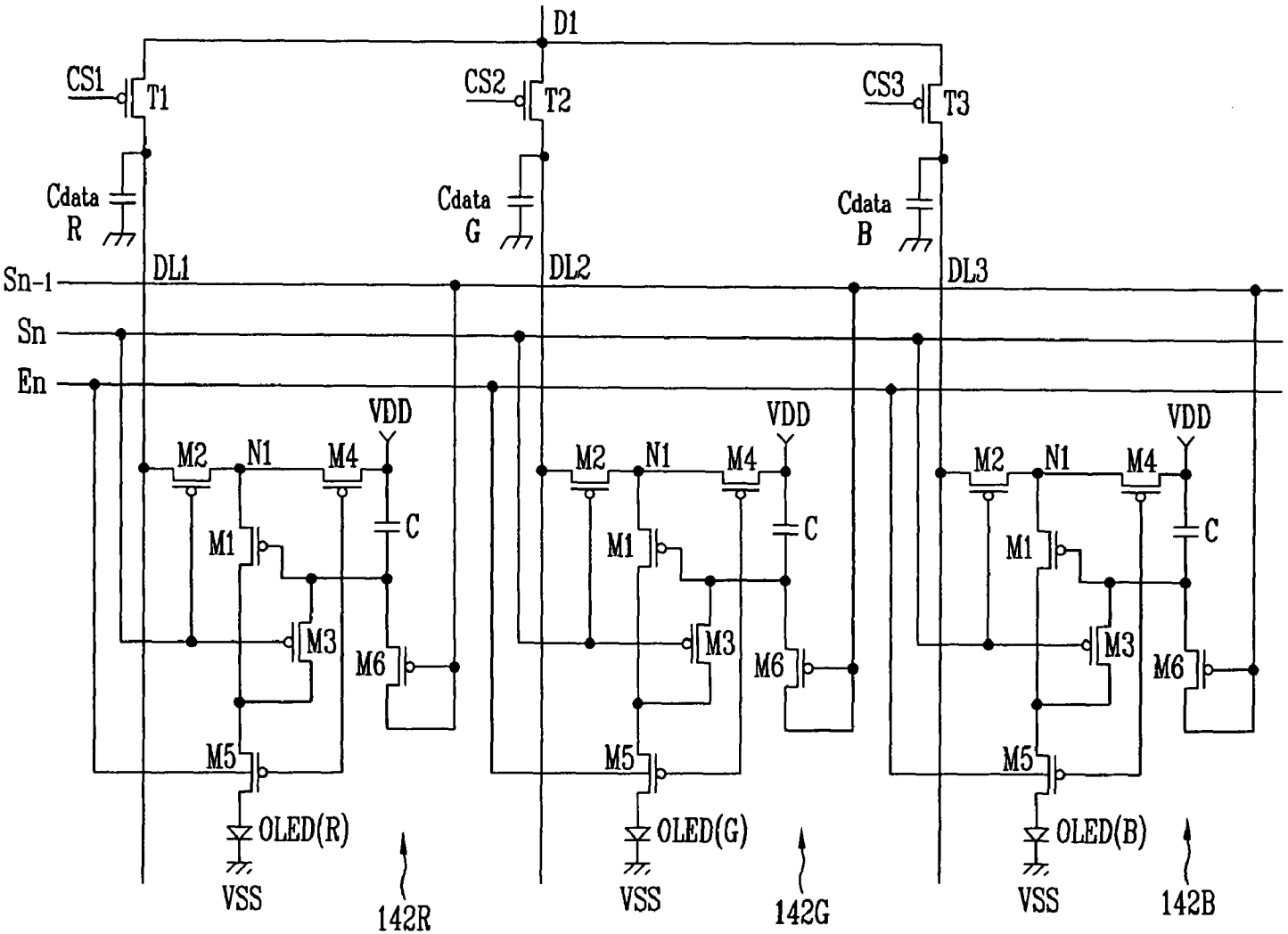
FIG. 6 is a circuit diagram showing coupling between the demultiplexers shown in FIG. 3 and the pixel shown in FIG. 5.

FIG. 6 is a circuit diagram showing coupling of the demultiplexer 162 shown in FIG. 3 and the pixel 140 shown in FIG. 5. It is assumed that three pixels of red (R), green (G), and blue (B) colors are coupled with one demultiplexer 162, namely that i=3.

Referring to FIG. 4 and FIG. 6, the scan signal SS is first supplied to the $n-1^{th}$ scan line Sn−1. When the scan signal SS is supplied to the $n-1^{th}$ scan line Sn−1, the sixth transistor M6 included in each of the pixel circuits 142R, 142G, 142B is turned on. As the sixth transistor M6 is turned on, the storage capacitor C and the gate terminal of the first transistor M1 are coupled with the $n-1^{th}$ scan line Sn−1. That is, when the scan signal SS is supplied to the $n-1^{th}$ scan line Sn−1, the scan signal SS is provided to the storage capacitor C and the gate terminal of the first transistor M1 in each of the pixel circuits 142R, 142G, 142B that allows the pixel circuits 142R, 142G, 142B to be initialized.

When the scan signal SS is being supplied to the $n-1^{th}$ scan line Sn−1, the second transistor M2 whose gate is coupled with the $n^{th}$ scan line Sn, maintains an off state.

Next, the first, second, and third control signals CS1, CS2, CS3 are sequentially provided during a data period, and the first switch T1, the second switch T2, and the third switch T3, are sequentially turned on. The first control signal CS1 turns on the first switch T1. When the first switch T1 is turned on, a data signal supplied to a first primary data line D1, is provided to a first secondary data line DL1. At this time, a voltage corresponding to the data signal supplied to the first secondary data line DL1, is charged in the first data capacitor CdataR.

The second control signal CS2 turns on the second switch T2. When the second switch T2 is turned on, a data signal supplied to the first primary data line D1, is provided to a second secondary data line DL2. At this time, a voltage corresponding to the data signal supplied to the second secondary data line DL2, is charged in the second data capacitor CdataG. The third control signal CS3 turns on the third transistor T3. When the third switch T3 is turned on, a data signal supplied to a first primary data line D1, is provided to a third secondary data line DL3. At this time, a voltage corresponding to the data signal supplied to the third secondary data line DL3, is charged in the third data capacitor CdataB. At the same time, because the scan signal SS is not supplied during the data period, the data signal is also supplied to the pixel circuits 142R, 142G, 142B while the control signals CS1, CS2, CS3 are being supplied.

During a scan period after the data period, a scan signal SS is supplied to the $n^{th}$ scan line Sn. When the scan signal SS is supplied to the $n^{th}$ scan line Sn, the second transistor M2 and the third transistor M3 included in each of the pixel circuits 142R, 142G, 142B are turned on. When the second transistor M2 and the third transistor M3 are turned on, a voltage corresponding to a data signal stored in the first through third capacitors CdataR, CdataG, CdataB is provided to the first node N1 of the pixel circuits 142R, 142G, 142B.

Because the gate terminal voltage of the first transistor M1 included in the pixel circuits 142R, 142G, 142B is initialized by the scan signal SS supplied to the $n-1^{th}$ scan line Sn−1, that is, this voltage is set to be lower than a voltage of the data signal applied to the first node N1, the first transistor M1 is turned on. When the first transistor M1 is turned on, a voltage corresponding to the data signal applied to the first node N1 is supplied to one plate of a storage capacitor C via the first transistor M1 and the third transistor M3. At this time, a voltage corresponding to the data signal is charged in the storage capacitor C included in each of the pixel circuits 142R, 142G, 142B. Besides the voltage corresponding to the data signal, a voltage corresponding to a threshold voltage of the first transistor M1 is also charged in the storage capacitor C. Thereafter, when a light emission control signal EMI is not being supplied to the light emission control line En, the fourth and fifth transistors M4, M5 are turned on, so that an electric current corresponding to the voltage charged in the storage capacitor C is supplied to organic light emitting diodes OLED (R), OLED(G), OLED(B), thereby generating red light, green light, and blue light of a predetermined brightness.

The present invention can provide the data signal supplied to each one of the primary data lines D to i secondary data lines DL using the demultiplexer 162. Furthermore, the present invention can charge a voltage corresponding to the data signal in the data capacitor Cdata during the data period, and supply the voltage charged in the data capacitor Cdata to the pixel during a scan period. Unless the scan period and the data period overlap with each other, the gate voltage of the third transistor M3 is not changed during the data period allowing an stable image to be displayed. The scan period is a period during which the scan signal SS is supplied, and the data period is a period during which the data signal R, G, B is supplied. Moreover, because the present invention simultaneously provides the voltage stored in the data capacitors Cdata to all of the pixels receiving the same scan signal SS, in other words simultaneously supplies the data signal, an image of uniform brightness can be displayed.

On the other hand, although the same data signal is applied to the light emitting elements OLED of the organic light emitting display, the light emitting elements OLED generate lights of different brightness according to their material properties. In fact, when the same data signal is applied to the organic light emitting elements OLED, as indicated in a following equation 1, the light emitting efficiency is highest in the blue light emitting element OLED(B), lower in the red light emitting element OLED(R), and lowest in the green light emitting element OLED(G).

$$B>R>G \tag{1}$$

When lights of different efficiencies are generated according to the color of the light emitting element OLED, white balance is not right, and an image of desired color can not be displayed. Accordingly, in the organic light emitting display of the present invention, the capacitance of the data capacitor Cdata is controlled in consideration of white balance. In other words, in the present invention, a second capacitor CdataG coupled with a green pixel G is designed to have the greatest capacitance, while the third data capacitor CdataB is designed to have the smallest capacitance. Accordingly, white balance of the red pixel R, the green pixel G, and the blue pixel B is adjusted to some degree, thereby causing an improvement in display quality.

A voltage Vg supplied to a gate terminal of the first transistor M1 included in each of the pixel circuits 142R, 142G, 142B is determined by a following equation 2.

$$Vg = \frac{(Cdata \times Vdata) + (C \times Vint)}{Cdata + C} \tag{2}$$

where, Vdata represents a voltage value corresponding to the data signal of a current frame stored in the data capacitor Cdata, and Vint represents a voltage value corresponding to a data signal of a previous frame stored in the storage capacitor C.

With reference to the equation 2, the higher the capacitance of the data capacitor Cdata, the greater the increase in the voltage Vg supplied to the gate terminal of the first transistor M1. For example, assuming that C=1 and Vint=1, a following equation 3 is obtained.

$$Vg = \frac{Cdata \times Vdata + 1}{Cdata + 1} \quad (3)$$

In equation 3, voltage of the data signal during the current frame is fixed at Vdata=10. Then, when Cdata is 10, Vg will be approximately 9.18V. When Cdata is 1000, Vg will be approximately 10V. Therefore, the greater the capacitance of the data capacitor Cdata, the higher the gate voltage Vg of the first transistor M1. When a higher voltage Vg is applied to the gate terminal of the first transistor M1, the voltage charged in the storage capacitor C is lower, causing the electric current to be supplied to the light emitting element OLED to be low. Therefore, in the present invention, capacitances are set in a decreasing order from the second data capacitor CdataG, to the first data capacitor CdataR, and the third data capacitor CdataB in order to adjust white balance.

Figure 7:
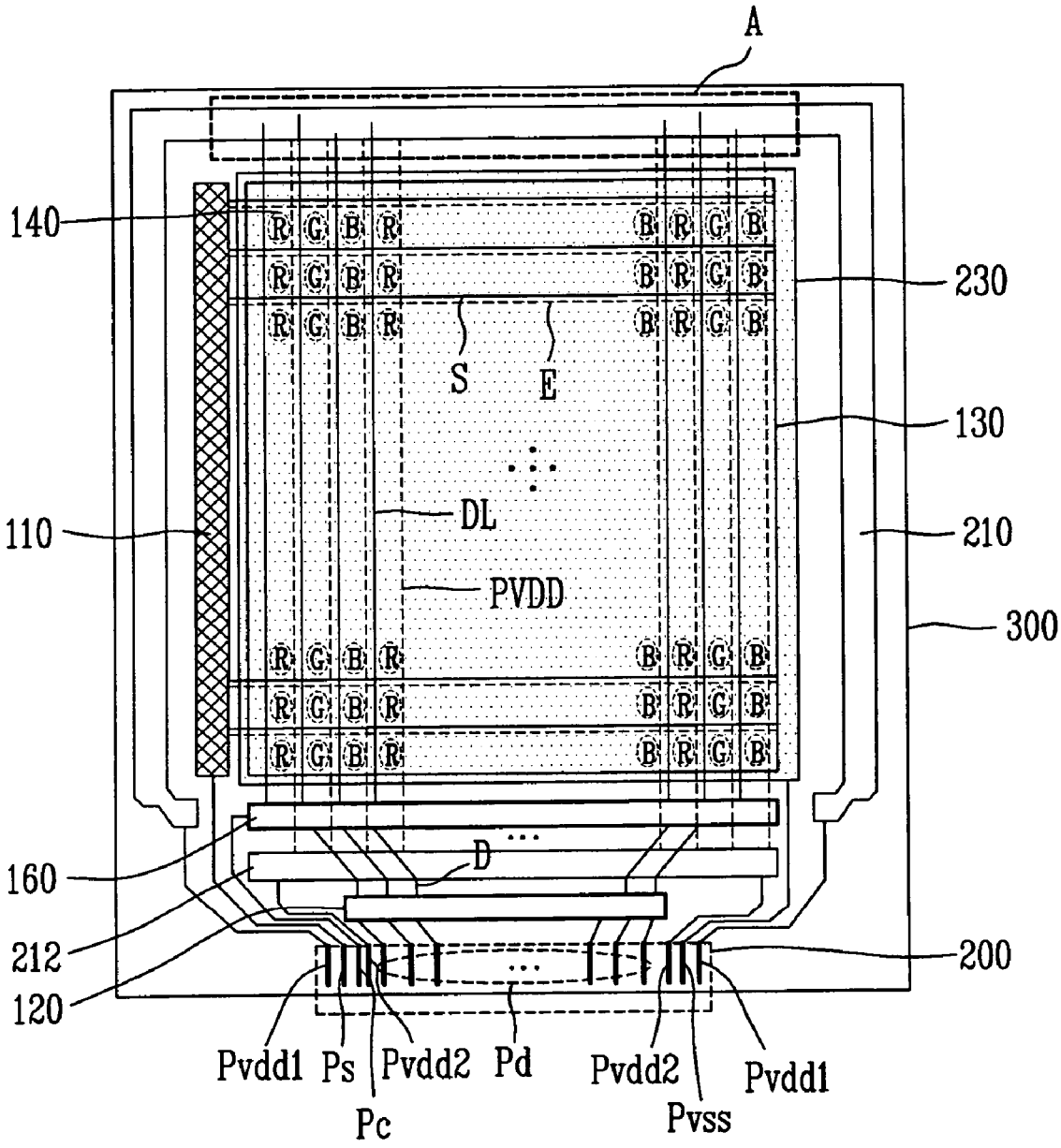
FIG. 7 shows a layout of an organic light emitting display according to an embodiment of the present invention.

FIG. 7 is a lay out showing an organic light emitting display according to an embodiment of the present invention. The organic light emitting display shown in this figure includes a pixel portion 130, a first power line 210, an auxiliary power line 212, a data driver 120, and a demultiplexer block 160. The pixel portion 130 includes a plurality of pixels 140 disposed on a substrate 300 and defined by a plurality of secondary data lines DL, scan lines S, and pixel power lines PVDD. The first power line 210 and the auxiliary power line 212 are coupled with the pixel power lines PVDD.

The organic light emitting display according to an embodiment of the present invention further includes a scan driver 110, a second power line 230, and a pad portion 200.

The scan driver 110 is disposed adjacent to one side of the pixel portion 130 and is electrically coupled to a first pad Ps of the pad portion 200. The scan driver 110 sequentially provides the scan signal SS to the scan lines S in response to a scan drive control signal SCS supplied from the first pad Ps during the scan period of one horizontal period 1H (FIG. 4).

The data driver 120 is electrically coupled to second pads Pd of the pad portion 200. The data driver 120 generates data signals in response to data drive control signals DCS and data Data from the second pad Pd, and provides the data signals to the primary data lines D. The data driver 120 provides i data signals to primary data lines D during the data period of one horizontal period 1H. The data driver 120 may be directly formed on a substrate 300 or be mounted on the substrate 300 in a chip form. The data driver 120 in a chip form may be mounted on the substrate 300 by a chip on glass method, a wire bonding method, free-chip method, or a beam lead method.

The first power line 210 is formed adjacent to both sides and an upper side of the pixel portion 130 along edges of the substrate 300 except the pad portion 200. Both ends of the first power line 210 are electrically coupled to a third pad Pvdd1 of the pad portion 200. The first power lines 210 provide a voltage of the first power supply VDD from the third pad Pvdd1 to one end of the pixel power lines PVDD.

The auxiliary power line 212 is formed adjacent to a lower side of the pixel portion 130. Both ends of the auxiliary power line 212 are electrically coupled to a fourth pad Pvdd2 of the pad portion 200. The auxiliary power line 212 provides the voltage of the first power supply VDD from the fourth pad Pvdd2 to the other end of the pixel power lines PVDD.

The second power line 230 is formed at a front surface of the pixel portion 130. The second power line 230 provides the voltage of the second power supply VSS from a fifth pad Pvss of the pad portion 200 to respective pixels 140 in common.

The demultiplexer block 160 provides i data signals from the primary data line D to i secondary data lines DL in response to control signals CS1, CS2, CS3 from a sixth pad Pc of the pad portion 200. The data signals sequentially supplied from the demultiplexer block 160 are stored in the data capacitor Cdata equivalently formed at the secondary data lines DL, and are simultaneously provided to pixels 140.

Data capacitors CdataR, CdataG, CdataB are coupled with their respective secondary data lines DL or equivalently formed on these lines. Taking into account light emitting efficiencies of the red light emitting element OLED(R), the green light emitting element OLED(G), and the blue light emitting element OLED(B), the second data capacitor CdataG coupled with the green pixel G is set to have a greater capacitance, whereas the third data capacitor CdataB coupled with the blue pixel B is set to have a smaller capacitance. Therefore, in the present invention, so as to adjust the capacitance of the data capacitor Cdata, a first overlapping area, a second overlapping area, and a third overlapping area are set differently from one another. The first overlapping area is an overlapping area between the first power line 210 and the secondary data line DL coupled with the red pixel R, the second overlapping area is an overlapping area between the first power line 210 and the secondary data line DL coupled with the green pixel G, and the third overlapping area is an overlapping area between the first power line 210 and the secondary data line DL coupled with the blue pixel B.

Figure 8:
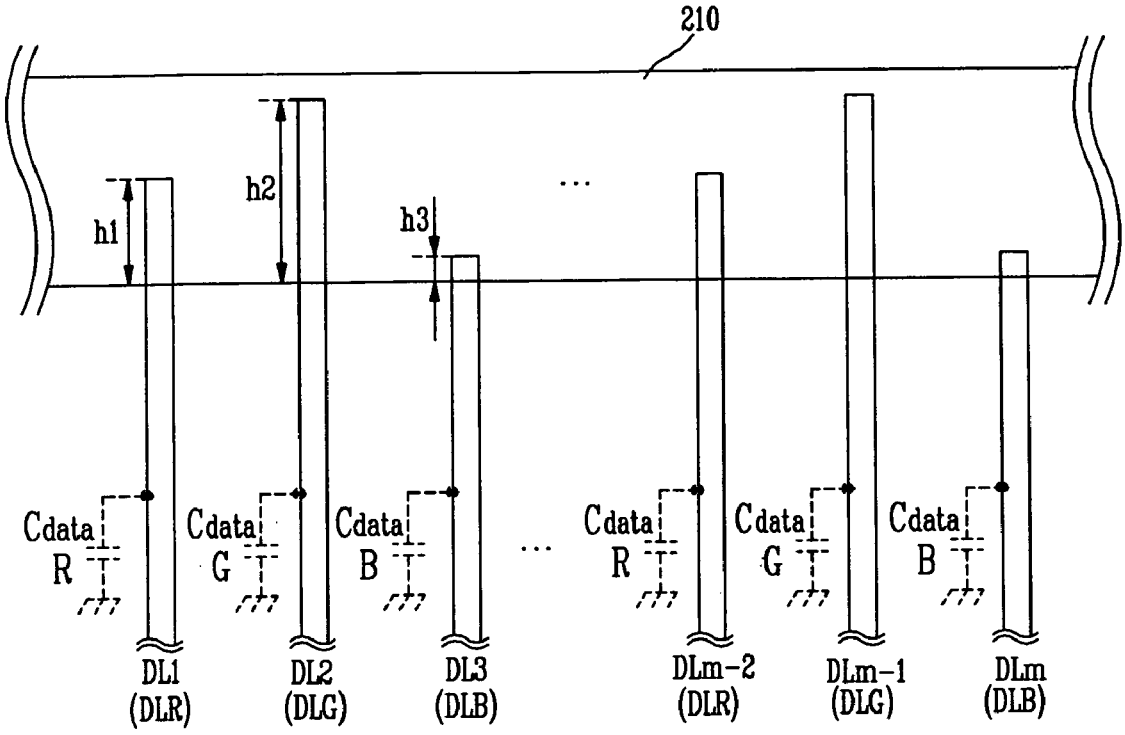
FIG. 8 is an enlarged view of a first example of an area A of FIG. 7.

FIG. 8 is an enlarged view showing a first example of an area A of FIG. 7 where the secondary data lines DL and the first power line 210 overlap. The data capacitors Cdata are shown as parasitic capacitors that are equivalently formed at the secondary data lines DL. A first data capacitor CdataR for supplying a voltage corresponding to a data signal to the red pixel R, a second data capacitor CdataG for supplying a voltage corresponding to a data signal to the green pixel G, and a third data capacitor CdataB for supplying a voltage corresponding to a data signal to the green pixel B, are set to have capacitance values different from one another.

The secondary data lines DL(R) coupled with the red pixel R overlap with the first power line 210 by a first length h1. Accordingly, capacitance of the first data capacitor CdataR is set to a predetermined value corresponding to the first length h1. The secondary data lines DL(G) coupled with the green pixel G overlap with the first power line 210 by a second length h2. Because the second length h2 is greater than the first length h1, the overlapping area is greater and the capacitance of the second capacitor CdataG is greater than that of the first capacitor CdataR. The secondary data lines DL(B) coupled with the blue pixel B overlap with the first power line 210 by a third length h3. Because the third length h3 is smaller than the second length h2, the overlapping area is smaller and the capacitance of the third capacitor CdataB is smaller than that of the first capacitor CdataR.

When the capacitance values of the data capacitor Cdata is set in a decreasing order of the second capacitor CdataG>the first capacitor CdataR>the third capacitor CdataB, an image of adjusted white balance may be displayed regardless of light emitting efficiency of red, green, and blue light emitting element OLEDs.

Figure 9:
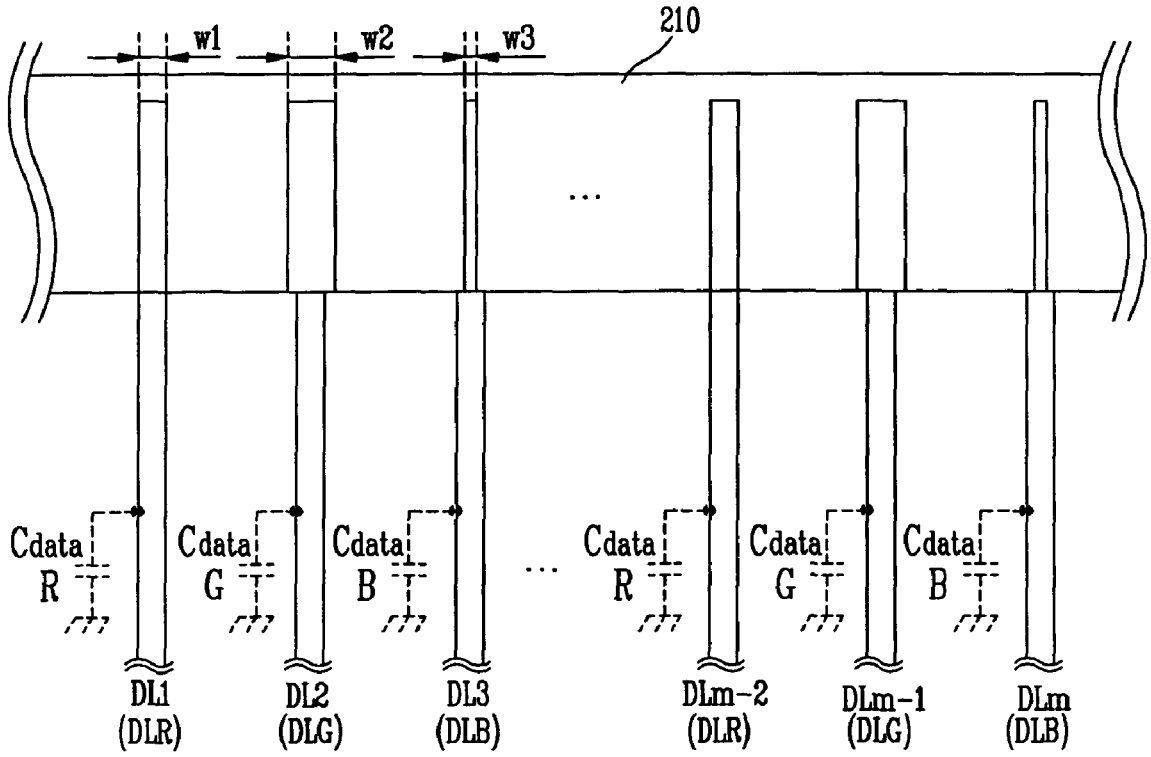
FIG. 9 is an enlarged view of a second example of the area A of FIG. 7.

FIG. 9 is an enlarged view of a second example of the area A of FIG. 7 where the secondary data lines DL and the first power line 210 overlap. Data capacitors Cdata are equivalently formed as parasitic capacitors at the secondary data lines DL. The first data capacitor CdataR for supplying the voltage corresponding to the data signal to the red pixel R, the second data capacitor CdataG for supplying the voltage corresponding to the data signal to the green pixel G, and the third data capacitor CdataB for supplying the voltage corresponding to the data to the green pixel B, are set to have capacitance values different from one another.

The secondary data lines DL(R) coupled with the red pixel R overlap with the first power line 210 by a first width w1. Accordingly, a capacitance of the first data capacitor CdataR is set to a predetermined capacitance value corresponding to the first width w1. The secondary data lines DL(G) coupled with the green pixel G overlap with the first power line 210 by a second width w2. Because the second width w2 is greater than the first width w1, the overlapping area is greater and the capacitance of the second capacitor CdataG is greater than that of the first capacitor CdataR. The secondary data lines DL(B) coupled with the blue pixel B overlap with the first power line 210 by a third width w3. Because the third width w3 is smaller than the first width w1, the overlapping area is smaller and the capacitance of the third capacitor CdataB is smaller than that of the first capacitor CdataR.

When the capacitance of the data capacitor Cdata is set in a decreasing order from the second capacitor CdataG>the first capacitor CdataR>the third capacitor CdataB, an image of adjusted white balance may be displayed regardless of light emitting efficiency of red, green, and blue light emitting element OLEDs.

As described above, in the organic light emitting display of the present invention, because a data signal supplied to one primary output line of the data driver is simultaneously provided to a plurality of secondary data lines, the number of primary output lines can be reduced, thereby reducing manufacturing cost. Furthermore, a voltage corresponding to the data signal is sequentially charged in data capacitors, and simultaneously provided to the pixels. When the voltage charged in the data capacitors is simultaneously provided to the pixels, an image of uniform brightness may be displayed by the pixels. Moreover, the scan period being the supply time of the scan signal SS and the data period being a supply time of the data signal are not overlapping, thus stably displaying an image. In addition, because the present invention sets capacitance values of data capacitors taking into consideration the light emitting efficiency of organic light emitting diodes, an image of adjusted white balance may be displayed.

Although exemplary embodiments of the present invention have been shown and described, it would be appreciated by those skilled in the art that changes might be made in this embodiment without departing from the principles and spirit of the invention, the scope of which is defined in the claims and their equivalents.

What is claimed is:

1. An organic light emitting display comprising:

a scan driver for supplying scan signals to a plurality of scan lines;

a data driver for supplying data signals to a plurality of output lines;

a plurality of demultiplexers coupled to the plurality of output lines for supplying corresponding ones of the data signals from each one of the output lines to a plurality of data lines, the plurality of data lines including a first group, a second group, and a third group;

a display portion coupled with the plurality of scan lines, the plurality of data lines, and a pixel power line, and including red pixels each having a red organic light emitting diode, green pixels each having a green organic light emitting diode, and blue pixels each having a blue organic light emitting diode;

wherein a plurality of first parasitic capacitances are formed at the first group of the plurality of data lines, the first parasitic capacitances associated with the red pixels, for storing first voltages corresponding to the data signals for the red pixels during a data period, and for applying the stored first voltages to the red pixels in accordance with the scan signals during a scan period different from the data period;

wherein a plurality of second parasitic capacitances are formed at the second group of the plurality of data lines, the second parasitic capacitances associated with the green pixels, for storing second voltages corresponding to the data signals for the green pixels during the data period, and for applying the stored second voltages to the green pixels in accordance with the scan signals during the scan period;

wherein a plurality of third parasitic capacitances are formed at the third group of the plurality of data lines, the third parasitic capacitances associated with the blue pixels, for storing third voltages corresponding to the data signals for the blue pixels during the data period, and for applying the stored third voltages to the blue pixels in accordance with the scan signals during the scan period, wherein the first parasitic-capacitances, the second parasitic capacitances, and the third parasitic capacitances have different capacitance values, and wherein the capacitance value of the second parasitic capacitances is greater than the capacitance value of the first parasitic capacitances and the capacitance value of the third parasitic capacitances is smaller than the capacitance value of the first parasitic capacitances.

2. The organic light emitting display as claimed in claim 1, further comprising a power line for providing a first power from an exterior to the pixel power line.

3. The organic light emitting display as claimed in claim 2, wherein a first overlapping area, a second overlapping area, and a third overlapping area are set differently from one another, the first overlapping area being an overlapping area between the power line and a data line coupled with a red pixel of the plurality of data lines, the second overlapping area being an overlapping area between the power line and a data line coupled with a green pixel of the plurality of data lines, and the third overlapping area being an overlapping area between the power line and a data line coupled with a blue pixel of the plurality of data lines.

4. The organic light emitting display as claimed in claim 3, wherein the first overlapping area is smaller than the second overlapping area but greater than the third overlapping area.

5. The organic light emitting display as claimed in claim 3, wherein the data line coupled with the red pixel overlaps with the power line by a first length, and the data line coupled with the green pixel overlaps with the power line by a second length greater than the first length.

6. The organic light emitting display as claimed in claim 5, wherein the data line coupled with the blue pixel overlaps with the power line by a third length smaller than the first length.

7. The organic light emitting display as claimed in claim 3, wherein a data line coupled with the red pixel overlaps with the power line by a first width, and the data line coupled with the green pixel overlaps with the power line by a second width greater than the first width.

8. The organic light emitting display as claimed in claim 7, wherein the data line coupled with the blue pixel overlaps with the power line by a third width smaller than the first width.

9. The organic light emitting display as claimed in claim 1, wherein the scan driver supplies the scan signal during a first period of one horizontal period, and the data driver supplies a plurality of data signals to the output lines during a second period of the one horizontal period not coinciding with the first period.

10. The organic light emitting display as claimed in claim 9, wherein each of the demultiplexers includes a plurality of transistors coupled with the plurality of data lines.

11. The organic light emitting display as claimed in claim 10, wherein the plurality of transistors are sequentially turned on, and wherein when the transistors are turned on, voltages corresponding to the data signals are stored by utilizing the first parasitic capacitances, the second parasitic capacitances, and the third parasitic capacitances.

12. The organic light emitting display as claimed in claim 11, wherein the voltages stored by utilizing the first parasitic capacitances, the second parasitic capacitances, and the third parasitic capacitances are supplied to the red pixels, the green pixels, and the blue pixels, respectively, during the first period.

* * * * *